US005183084A

United States Patent [19]

Moeneclaey, Denis

[11] Patent Number: 5,183,084

[45] Date of Patent: Feb. 2, 1993

[54] RAPIER GUIDE WITH TWO SERIES OF GUIDE ELEMENTS

[75] Inventor: Moeneclaey, Denis, Oostnieuwkerke-Staden, Belgium

[73] Assignee: Picanol N.V., naamloze vennootschap, Belgium

[21] Appl. No.: 549,083

[22] Filed: Jul. 6, 1990

[30] Foreign Application Priority Data

Jul. 6, 1989 [BE] Belgium ..... 08900738

[51] Int. Cl.[5] ..... D03D 47/00

[52] U.S. Cl. ..... 139/449

[58] Field of Search ..... 139/449, 188 R, 440, 139/442, 443, 444, 445, 446

[56] References Cited

U.S. PATENT DOCUMENTS

| | | | |
|---|---|---|---|
| 3,299,911 | 1/1967 | Dewas . | |
| 4,628,968 | 12/1986 | Burer | 139/188 R |
| 4,638,839 | 1/1987 | Pezzoli | 139/449 |
| 4,653,545 | 3/1987 | Riesen | 139/188 R |
| 4,669,513 | 6/1987 | Hintsch | 139/449 X |

FOREIGN PATENT DOCUMENTS

| | | | |
|---|---|---|---|
| 0077866 | 5/1983 | European Pat. Off. . | |
| 0199880 | 11/1986 | European Pat. Off. | 139/449 |
| 1476950 | 4/1967 | France . | |

OTHER PUBLICATIONS

Zeller, "Greiferwebmaschinen", *Textile Practice International*, Apr. 1983, pp. 318-322.

*Primary Examiner*—Andrew M. Falik
*Attorney, Agent, or Firm*—Bacon & Thomas

[57] ABSTRACT

The rapier guide of a gripper weaving machine includes at least two series of guide elements for guiding the rapiers in the shed. The two series are presented in the shed at the backmost position of the sley to guide the rapiers on both sides thereof. In the series of guide elements which is situated closest to the reed, those guide elements situated nearest the ends of the shed are arranged to also be situated, in all positions of the sley, essentially underneath the plane formed by the undersides of the rapiers.

16 Claims, 4 Drawing Sheets

RAPIER GUIDE WITH TWO SERIES OF GUIDE ELEMENTS

BACKGROUND OF THE INVENTION

The present invention concerns a gripper weaving machine in which the rapier guide includes two series of guide elements for guiding the rapiers in the shed which are presented when the sley is in its backmost position to guide the rapiers on both sides.

It is known that such rapier guides can be made in various embodiments. Traditionally, two series of guide elements are used, preferably in the form of small hooks, which operate in conjunction with the sides of the rapiers, for example as described in patents U.S. Pat. No. 3,299,911, BE 902,913, DE 869,477, FR 1,476,950 and patent applications NL 7607608, FR 2,217,451 and EP 137,376. The use of this type of rapier guide has the disadvantage that the weft threads are easily caught in the guide elements which are situated closests to the reed when the sley is moved forward again. This occurs in particular in weaves where the position of the bottommost warp threads remains unchanged during the insertion of several weft threads.

The use of rapier guides known from the above-mentioned patents also has the disadvantage, at least in the case when the rapier drive is fixed and does not move along with the sley, that the insertion of the rapiers in the shed can only start as soon as the sley and the guide elements fixed to it are in their backward position; additionally, the rapiers must be removed from the shed as soon as the sley is moved forward again. In order to accelerate the weaving process, it is required that the rapiers and the sley can make overlapping movements.

French patent No. 1,467,950 describes a device which partly allows such overlaps. This is due to the fact that the top of the rapier is rounded off so that the rapier makes contact with the rapier guide elements only later, such that these rapier guide elements still have some freedom of movement. This solution has the disadvantage that the overlap remains limited.

It is also known for rapier guides to consist on the one hand of guide hooks which operate in conjunction with that side of the rapier which is turned away from the reed, and on the other hand of a support which is located underneath the bottommost warp threads, for example as described in the Belgian patent No. 900,044, the Dutch patent application No. 7607608 and the European patent application No. 204,274. In this arrangement the rapiers slide over the bottommost warp threads, and therefore this arrangement has the disadvantage that the warp threads with which the rapiers make contact are easily damaged. This arrangement also has the disadvantage that the harness drive must see to it that the bottommost warp threads are in their bottommost position before the rapiers are inserted in the shed. As a result, the overlap of the movement of the harnesses and the rapiers is limited.

SUMMARY OF THE INVENTION

The present invention concerns a gripper weaving machine with a rapier guide which does not have any of the above-mentioned disadvantages. It therefore has as its subject a gripper weaving machine of the type where the rapier guide for guiding the rapiers in the shed includes two series of guide elements which guide the rapiers on both sides and which are both presented in the shed when the sley is moving backward, the guide elements of the series which is situated closest to the reed and which is situated near the ends of the shed being located, in all positions of the sley, underneath the plane formed by the underside of the rapiers. The guide elements of the series which is situated furthest from the reed have such a shape that they can be presented sideways to the rapiers when the rapiers have already been partly inserted in the shed.

This arrangement offers the advantage that the overlap of the movements of the sley and the rapiers is still possible when the rapier is guided on both sides by means of guide elements.

BRIEF DESCRIPTION OF THE DRAWINGS

In order to explain better the characteristics of the invention, by way of example only and without being limitative in any way, the following preferred embodiments are described with reference to the accompanying drawings, where.

DETAILED DESCRIPTION OF THE PREFERRED EMBODIMENT

Figure 1:
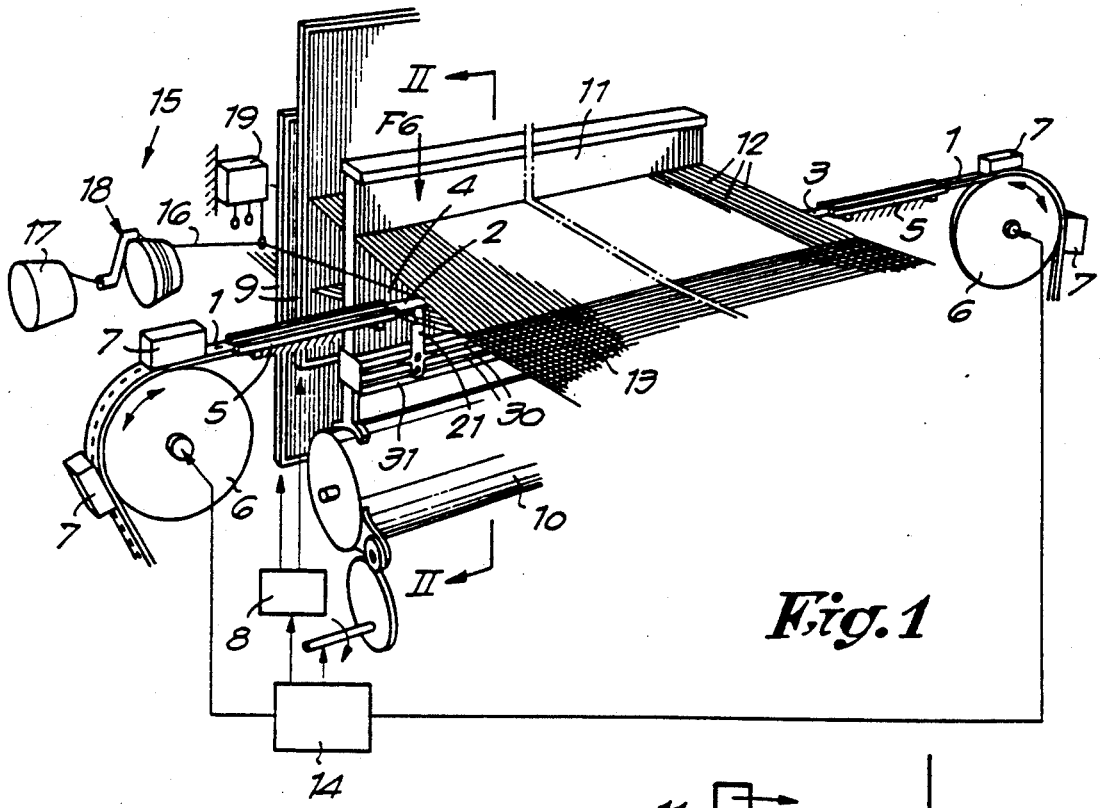
FIG. 1 is a schematic representation of a gripper weaving machine.
Figure 2:
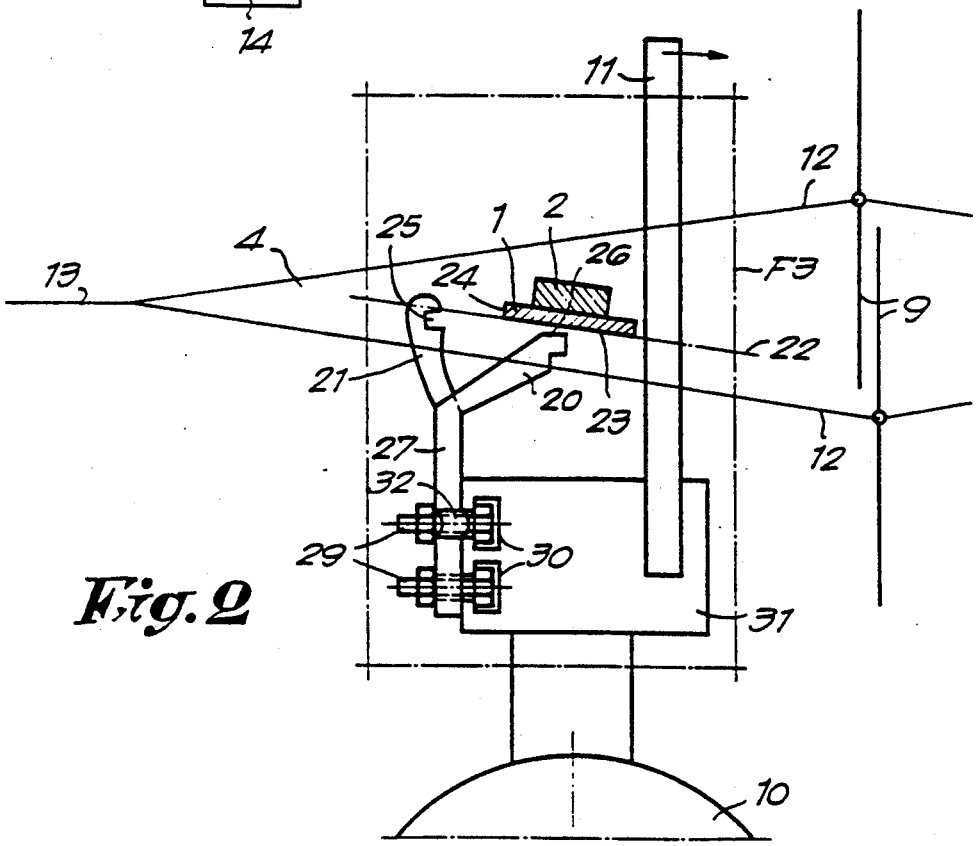
FIG. 2 shows a cross-section according to line II—II in FIG. 1, particularly of the guide elements according to the invention.

FIG. 1 is a schematic representation of the main components of the gripper weaving machine, particularly the rapiers 1; the feed gripper 2; the receiving gripper 3; the rapier drive which includes rapier guides 5 fixed next to both ends of the shed 4, the driving wheels 6 moving to and fro for the respective rapiers 1, and guide means 7 which keep the rapiers 1 in contact with the respective driving wheels 6; the harness drive 8 for driving the harnesses 9; the sley 10 with the reed 11; the warp threads 12; the formed cloth 13; drive means 14 for driving the sley 10, the harness drive 8 and the driving wheels 6; and the means 15 for supplying weft threads 16 to the feed gripper 2. Means 15 include, for example, one or more feed bobbins 17, a prewinder 18 and a thread presentation mechanism 19. For guiding the rapiers 1 in the shed 4 as shown in FIG. 2, two series of guide elements are used, which are both presented in the shed 4 when the sley 10 is moving backward, in other words away from the fabric. One series is formed by guide elements 20, which are situated closest to the reed 11 and intended to support the rapiers 1 at of the rapiers also situated closest to the reed 11.

Another series is formed by guide elements 21 which are located at a longer distance from the reed 11 and which are intended to support the rapiers 1 at sides of the rapiers which are situated furthest from the reed 11. The guide elements 20 and 21 are, as described below, fixed to the sley 10.

According to the present invention, the guide elements 20 of the series which is situated closest to the reed 11 are essentially located underneath the plane 22 formed by the undersides 23 of the rapiers 1 in all positions of the sley 10. Moreover, the guide elements 21 of the second series, as well as the side-edges 24 of the rapiers 1 and 2, are formed so that the guide elements 21 can be presented sideways to the rapiers 1 by the movement of the sley 10, when these rapiers 1 have already been partly inserted in the shed 4. For this purpose, at least in the case of flat rapiers 1, the side of the guide elements 21 is provided with U-shaped recesses 25, which can encompass the side-edge 24.

According to the invention, guide elements 20 each have an upper side 26 which can make contact with the underside 23 of the respective rapier 1.

Figure 3:
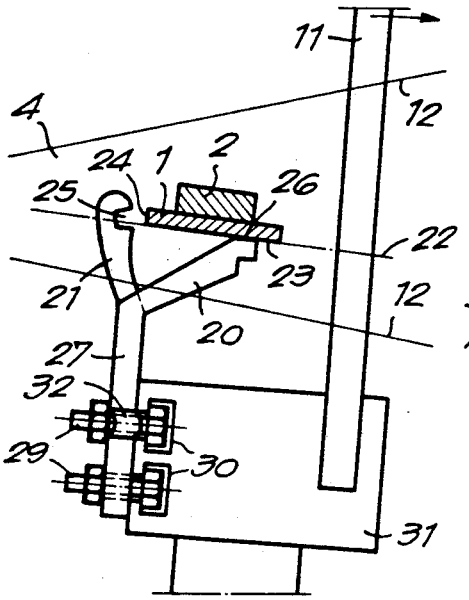
FIGS. 3 and 4 show a view similar to that of FIG. 2, for the various positions of the sley.
Figure 4:
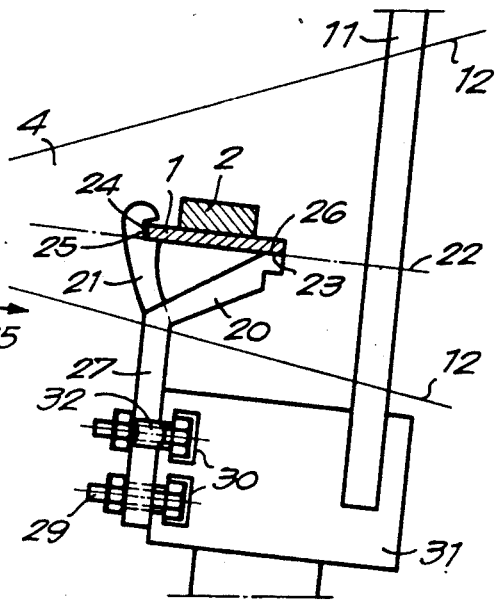

As shown in the various positions of FIGS. 2 to 4, the use of the guide elements 20 and 21 offers the above-mentioned advantage that a relatively large overlap of the movement of the sley 10 and both rapiers 1 is possible, such that the insertion of the rapiers 1 does not have to wait for the guide elements 20 and 21 to take their backmost position.

This offers the advantage that, at least in the case of rapiers 1 with a flat underside 23, these rapiers can already be inserted as soon as the position of the reed 11 no longer impedes this movement. As described in FIG. 2, the guide elements 20 and 21 which are situated near the ends of the shed 4 do not perform a guiding function yet at the start of the insertion of the rapiers.

When the sley 10 is moved further backward, the upper side 26 of the guide elements 20 which are situated near the ends of the shed 4 as mentioned above comes into contact with the underside 23 of the rapiers 1, also under the influence of the sagging of these rapiers, as shown in FIG. 3. It is clear that, from that moment on, the rapiers 1 are already partly supported.

When the sley 10 has reached its backmost position, the side edges 24 of the rapiers 1 are caught in the U-shaped recesses 25 of the above-mentioned guide elements 21, such that full guidance is provided at that moment, as shown in FIG. 4. At this moment, every rapier has travelled, for example, almost half the distance to the middle of the shed. When the rapiers 1 are further inserted in shed 4, the sley 10 practically remains in its backmost position.

It is clear that the guide elements 20 and 21 which are located further from the ends of shed 4, in other words, which are reached by the rapiers 1 when the sley 10 is in its backmost position, always provide full guidance of the rapiers 1.

It is also clear that, when using the above-mentioned rapier guide, the rapiers 1 can only be inserted in the shed 4 as soon as the shed 4 is sufficiently opened, in order not to impede the insertion of the rapiers 1. FIGS. 2 to 4 show the consecutive situations for the opening of the shed 4.

When the sley 10 is moved forward again, the cycle repeats itself in the reverse order as described above, in other words, the situations shown in FIGS. 4, 3 and 2 respectively occur so that the guide elements of both series follow each other alternately in the direction of a weft insertion over at least part of the shed.

It is clear that, through the shape of the guide elements 20, the weft threads cannot be caught behind these guide elements 20 as the sley 10 moves forward again.

As shown in FIGS. 2 to 5, the guide elements 20 and 21 are preferably fixed separately to the sley 10, by means of supports 27 and 28, provided with screwing means, which essentially consist of two bolts 29 and their respective nuts, and which can cooperate with the grooves 30 in the reed beam 31. The positioning perpendicular to this reed beam 31 can be obtained by means of cross pieces 32 and 33, provided at the supports 27 and 28, and meshing in at least one of the grooves 30.

Figure 5:
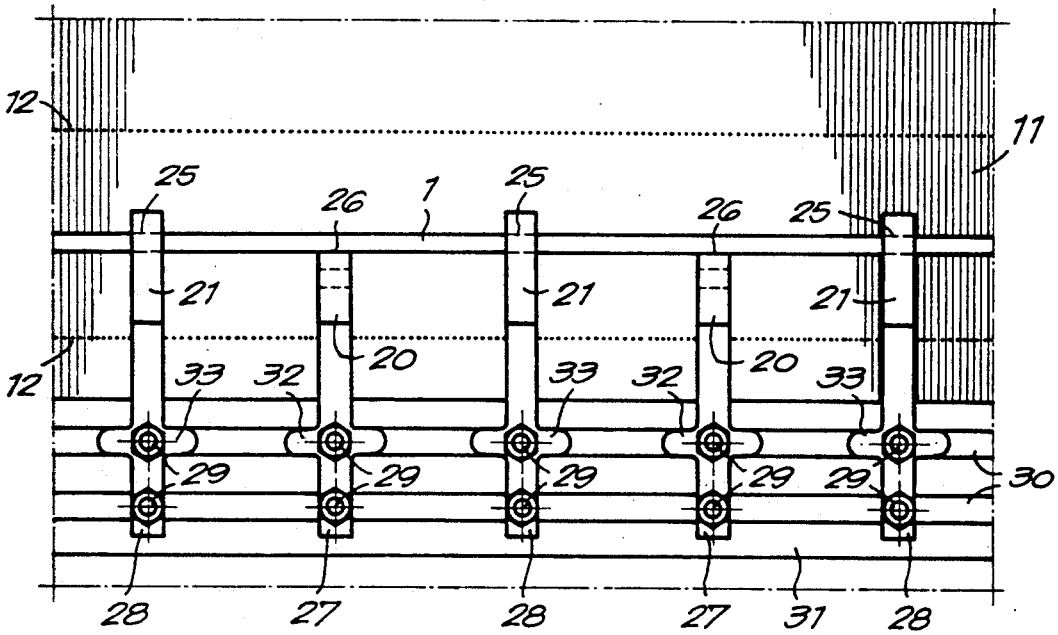
FIG. 5 shows a view according to arrow F5 in FIG. 4.

In order for the rapiers 1 to pass smoothly along the guide elements 20 and 21, the guide elements 20 and 21 are preferably arranged in alternating positions over at least a part of the length of the shed 4, in particular as shown in FIG. 5.

Figure 6:
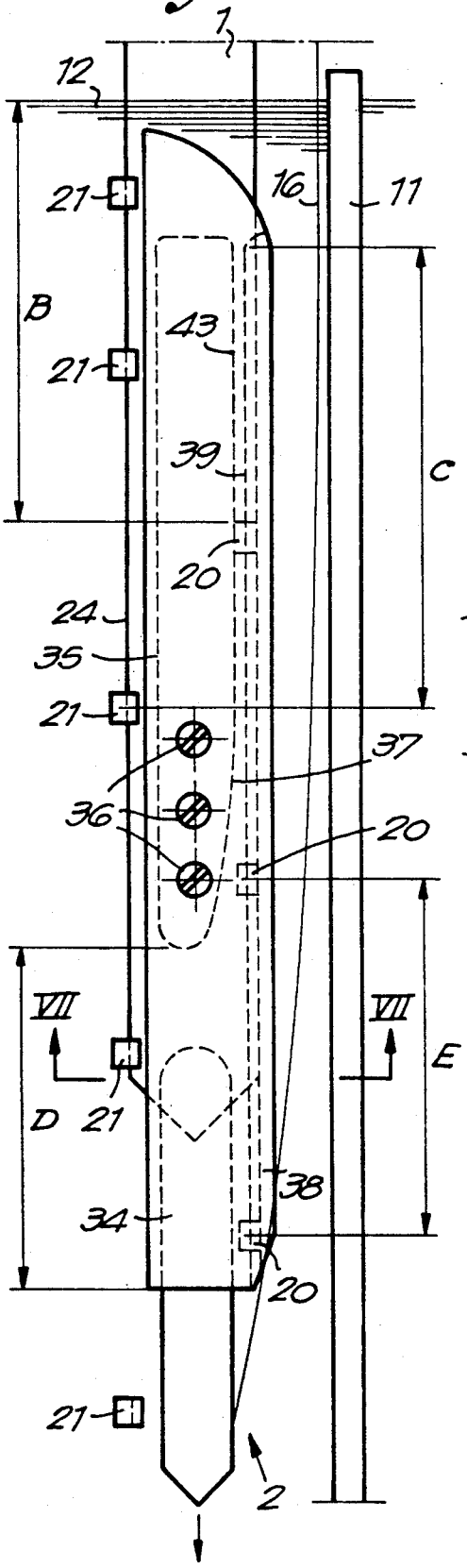
FIG. 6 shows a view according to arrow F6 in FIG. 1 for a special embodiment.
Figure 7:
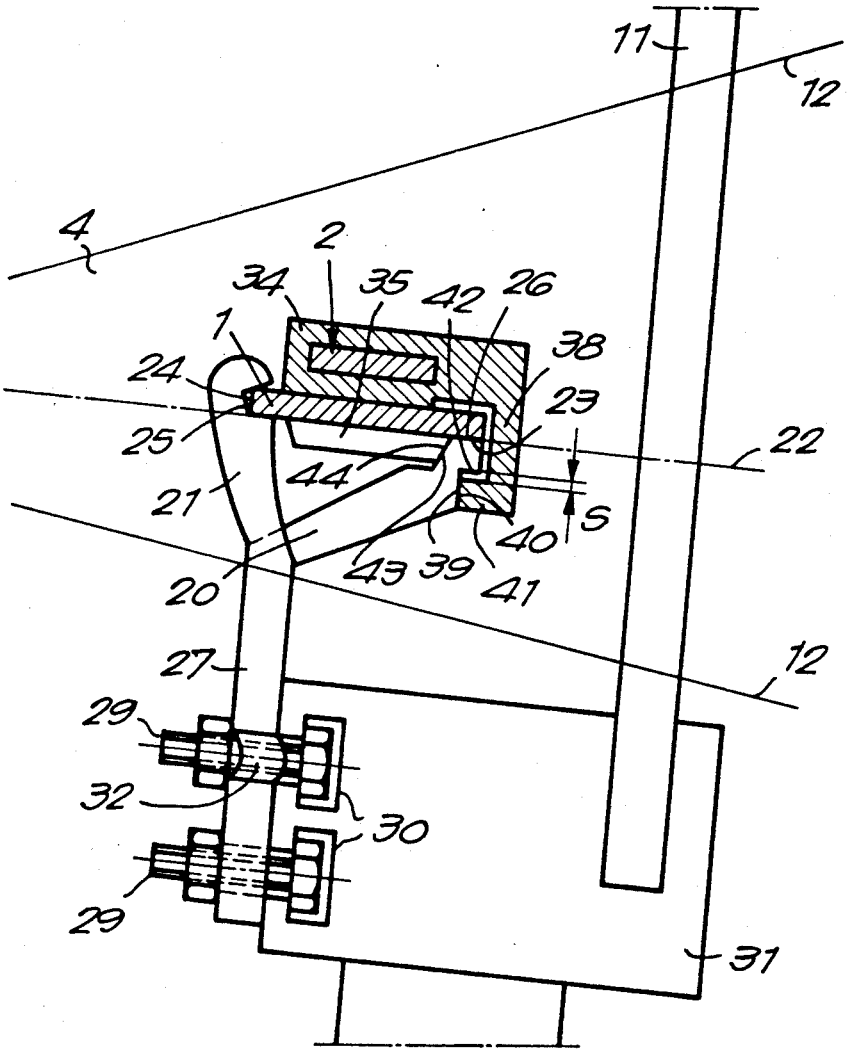
FIG. 7 shows a cross-section according to line VII—VII in FIG. 6.

In practice, each of the rapiers 1 is usually provided on the one hand with a fastening part 34 for fastening the grippers 2 and 3, the fastening parts partly protruding from the front ends of the rapiers 1, and on the other hand with a guide part 35 attached underneath the rapiers 1, for example by means of screws 36 which reach through the fastening part 34. The guide part 35 is fixed symmetrically to the rapier 1, for example, and can also serve as a reinforcing part. In FIGS. 6 and 7 the above is clarified for the fastening of the feed gripper 2.

It is clear that, to some extent, the guide part 35 impedes the movement of the guide elements 20 along the underside 23 of the rapiers 1. The guide elements 20 must therefore be moved underneath the rapiers 1 before the guide part 35 reaches these guide elements 20. However, the overlap of the movements of the sley 10 and the rapiers 1 remains possible, because of the manner in which guide part 35 is situated backwards in relation to the top of the gripper, particularly at a well-defined distance D from the front end of the fastening part 34 concerned. The overlap of the movements of the sley 10 and the rapiers 1 is therefore smaller than in the embodiments shown in FIGS. 2 to 4, yet the advantage of the inventions largely remains.

In order to increase the overlap of the above-mentioned movements in the case of an embodiment according to FIGS. 6 and 7, it is preferred according to the invention that only the guide elements 21 from the series which is situated furthest from the reed 11 be applied, over well-defined distances B, respectively starting at both ends of the shed 4. Moreover, the guide part 35 at the side which is directed towards the reed 11 is provided according to the invention with a bevel 37, which has the advantage that the sley 10 does not need to be placed in its backmost position when the front end of the guide part 35 passes the first guide element 20.

As shown in FIG. 7, the fastening part 34 has a further part 38 at the side directed towards the reed 11. Part 38 preferably extends downwardly as far as underneath the underside 23 of a corresponding rapier 1. As a result, part 38 and the guide elements 20 are both provided with side planes 39 and 40 which operate in conjunction with each other, thus forming an additional guide. Because the part 38 is located at that side of the rapier 1 which is directed towards the reed 11, the presence of this part 38 is no impediment for the insertion of the rapier 1, the shed 4 near the reed 11 being the largest shed.

Additionally, the part 38 can have a hook-shaped section 41, which meshes underneath the guide elements 20, thus forming a guide which essentially functions as a safety, preventing the corresponding rapier 1 from moving upward at the height of a respective guide element 20. Preferably, there is a play S between the section 41 and the planes 42 of the guide element 20, which operate in conjunction with section 41. Thanks to this construction, said part 38 does not impede the movement of the guide elements 20 along the undersides 23 of the rapiers 1. The part 38 and the section 41 can of course make up part of another piece fixed to the rapier 1.

As is shown in FIGS. 6 and 7, guide part 35 has a side plane 43 which operates in conjunction with the side plane 44 of the guide elements 20 as the rapier 1 is further inserted, while, as mentioned above, the side planes 39 and 40 also operate in conjuction with each other, such that full guidance is finally obtained in all directions. The side plane 39 of the part 38 runs over a distance C parallel to the side plane 43 of the guide part 35. It should be noted that the distance C must at least be equal to the distance E between the two guide elements 20, such that one guide element 20 always provides full guidance.

Figure 8:
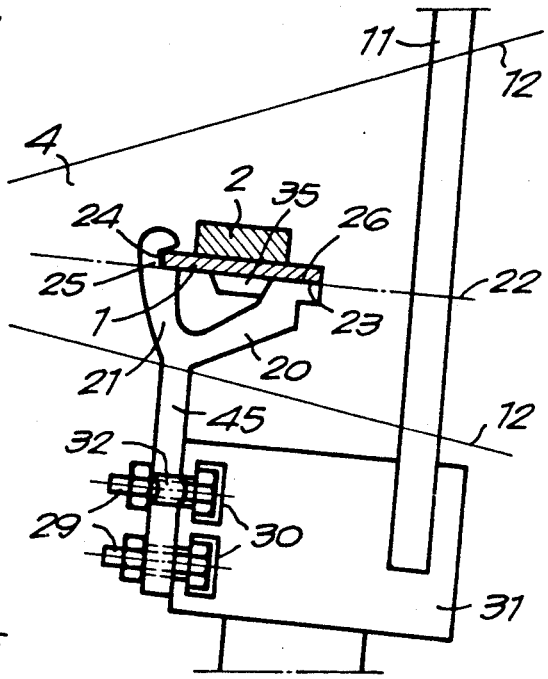
FIG. 8 shows another special embodiment of the rapier guide according to the invention.

FIG. 8 shows another variant of the invention, in which at least a part of the guide elements 20 and 21 form pairs, consisting of a guide element of each of the series, causing both guide elements 20 and 21 to be situated on the same place according to the weft breadth and have one common support 45.

It is clear in this embodiment that the guide elements 20 of the series which is situated closest to the reed 11 and farthest from the ends of the shed 4 do not affect the overlap of the movements of the sley 10 and the rapiers 1, and therefore these guide elements need not necessarily be situated completely under the plane 22 formed by the undersides 23 of the rapiers. However, they must be constructed such that they cannot catch the weft threads as the sley 10 is moved forward.

The present invention is in no way limited to the embodiments described by way of example and shown in the drawings; on the contrary, such a gripper weaving machine, and particularly the rapier guide as described above for guiding rapiers in the shed, can be made in various forms and dimensions while still remaining within the scope of the invention.

I claim:

1. A gripper weaving machine including rapiers, a shed having ends, a sley, and a reed, and comprising means including a rapier guide for guiding the rapiers in the shed, the rapier guide including means comprising two series of guide elements disposed along the shed for guiding the rapiers, means for situating a first of said series of guide elements closest to the reed to guide a side of the rapier situated closest to the reed, means for situating a second of said series of guide elements furthest from the reed to guide a side of the rapier situated furthest from the reed, means for presenting each of said two series in the shed as the sley is moved backward, and means for situating at least every portion of the guide elements of the first series which are situated closest to ends of the shed underneath a plane formed by the undersides of the rapiers, in all positions of the sley.

2. A gripper weaving machine as claimed in claim 1, wherein said means for situating the guide elements of the first series which are closest to ends of the shed comprise means for situating all guide elements of the first series essentially underneath the plane formed by the undersides of the rapiers, in all positions of the sley.

3. A gripper weaving machine as claimed in claim 1, wherein said means for situating the guide elements of the first series which are closest to ends of the shed comprise means including upper sides of the guide elements of the series which is situated closest to the reed for contacting the undersides of the rapiers.

4. A gripper weaving machine as claimed in claim 1, wherein the guide elements of a series which is situated furthest from the reed, as well as the rapiers, have a shape which constitutes means for presenting said guide elements sideways to a rapier after they have already been partly inserted into the shed.

5. A gripper weaving machine as claimed in claim 4, wherein the rapiers have rectangular-side edges, and wherein sides of the guide elements of a series which is situated furthest away from the reed include U-shaped recesses.

6. A gripper weaving machine as claimed in claim 1, wherein an end of at least one of the rapiers has a fastening part which includes a further part extending downwardly to underneath an underside of said at least one of the rapiers, and wherein the guide elements which are situated closest to the reed have side planes which cooperate with a side plane of said further part.

7. A gripper weaving machine as claimed in claim 6, wherein said further part includes a hood-shaped section which acts underneath the guide elements of the series closest to the reed.

8. A gripper weaving machine as claimed in claim 6, wherein a guide part is fixed to an underside of at least one of the rapiers, and wherein the guide part has a side plane which cooperates with one of side plane of the guide elements which are situated closest to the reed such that said one of said side planes of the guide elements runs parallel with said first side plane of said further part of the fastening part.

9. A gripper weaving machine as claimed in claim 8, wherein said guide part has a bevel near its front end and at a side which is situated closest to the reed.

10. A gripper weaving machine as claimed in claim 1, further comprising a guide part fixed to an underside of at least one of the rapiers, wherein the guide part has a side plane which contacts side planes of guide elements situated closest to the reed when the rapier is inserted, said guide element side planes being directed away from the reed.

11. A gripper weaving machine as claimed in claim 1, further comprising means for causing the guide elements of both series to follow each other alternately in the direction of a weft insertion over at least part of the length of the shed.

12. A gripper weaving machine as claimed in claim 1, further comprising means for causing only the guide elements of the second series to occur over a well-defined distance respectively starting at ends of the shed.

13. A gripper weaving machine as claimed in claim 1, further comprising means for causing at least a part of the guide elements of the first and second series to form pairs, said pairs comprising a guide element of each series, and means for causing both guide elements of respective pairs to be situated in the same place in respect to a breadth of weft threads, and wherein both said guide elements have a common support.

14. A gripper weaving machine as claimed in claim 1, further comprising drive means for driving the sley and driving wheels of the rapiers such that the rapiers are already inserted in the shed before the sley and the guide elements fixed to it have taken a backmost position.

15. A gripper weaving machine as claimed in claim 1, wherein rapier drives are fixed next to the sley.

16. A gripper weaving machine as claimed in claim 1, wherein the guide elements are fixed to the sley by means of supports, the supports being provided with screwing means for meshing in two grooves of a reed beam whereby each support has at least one cross piece meshing in one of said grooves.

* * * * *